US005274980A

United States Patent [19]

Zeigler

[11] Patent Number: 5,274,980

[45] Date of Patent: Jan. 4, 1994

[54] POLYHEDRON BUILDING SYSTEM HAVING TELESCOPING SCISSORS

[75] Inventor: Theodore R. Zeigler, Alexandria, Va.

[73] Assignee: World Shelters, Inc., Alexandria, Va.

[21] Appl. No.: 811,978

[22] Filed: Dec. 23, 1991

[51] Int. Cl.[5] ..... E04H 15/46

[52] U.S. Cl. ..... 52/646; 135/107; 135/108; 135/112; 135/908

[58] Field of Search ..... 135/103, 107, 108, 109, 135/906, 908, 97, 102, 110, 112; 52/646, 109, 80, 81

[56] References Cited

U.S. PATENT DOCUMENTS

| | | | |
|---|---|---|---|
| 1,773,847 | 8/1930 | Nickles . | |
| 1,790,134 | 1/1931 | Cooper . | |
| 3,063,521 | 11/1962 | Fuller . | |
| 3,185,164 | 5/1965 | Pinero . | |
| 3,381,923 | 5/1968 | Berry | 52/109 |
| 3,710,806 | 1/1973 | Kelly et al. | 135/4 R |
| 3,940,892 | 3/1976 | Lindbergh | 52/86 |
| 3,968,808 | 7/1976 | Zeigler | 135/4 R |
| 3,973,370 | 8/1976 | McAllister | 52/745 |
| 4,017,932 | 4/1977 | Lotto et al. | 14/2.4 |
| 4,026,313 | 5/1977 | Zeigler | 135/4 R |
| 4,280,521 | 7/1981 | Zeigler | 135/4 R |
| 4,290,244 | 9/1981 | Zeigler | 52/80 |
| 4,400,926 | 8/1983 | Tuggle | 52/646 |
| 4,437,275 | 3/1984 | Zeigler | 52/109 |
| 4,473,986 | 10/1984 | Zeigler | 52/645 |
| 4,512,097 | 4/1985 | Zeigler | 40/611 |
| 4,522,008 | 6/1985 | Zeigler | 52/646 |
| 4,561,618 | 12/1985 | Zeigler | 248/166 |
| 4,579,066 | 4/1986 | Zeigler | 108/157 |
| 4,607,656 | 8/1986 | Carter | 135/110 |
| 4,633,624 | 1/1987 | Targetti | 52/28 |
| 4,641,477 | 2/1987 | Schleck | 52/646 |
| 4,641,676 | 2/1987 | Lynch | 135/110 |
| 4,655,022 | 4/1987 | Natori | 52/646 |
| 4,677,803 | 7/1987 | Mikulas, Jr. et al. | 52/646 |
| 4,689,932 | 9/1987 | Zeigler | 52/648 |
| 4,745,725 | 5/1988 | Onoda | 52/646 |
| 4,761,729 | 8/1988 | Brion | 364/200 |
| 4,761,929 | 8/1988 | Zeigler | 52/646 |
| 4,779,635 | 10/1988 | Lynch | 135/97 |
| 4,809,471 | 3/1989 | Wichman et al. | 52/109 |
| 4,838,003 | 6/1989 | Zeigler | 52/646 |
| 4,846,204 | 7/1989 | Sok Kyu | 135/106 |
| 4,860,504 | 8/1989 | Lawrence | 52/86 |
| 4,885,891 | 12/1989 | Lynch | 52/646 |
| 4,888,895 | 12/1989 | Kemeny | 40/610 |
| 4,942,686 | 7/1990 | Kemeny | 40/610 |
| 4,947,884 | 8/1990 | Lynch | 135/97 |

*Primary Examiner*—Carl D. Friedman
*Assistant Examiner*—Matthew E. Leno
*Attorney, Agent, or Firm*—Burns, Doane, Swecker & Mathis

[57] ABSTRACT

A collapsible framework capable of being manipulated between a collapsed condition and an expanded, locked condition includes a plurality of legs and a plurality of collapsible quad sections. The legs are disposed generally in parallel with one another and in a bundle when the framework is in the collapsed condition. Each quad section includes two split step scissor units and two step scissor units. Each split step scissor unit is joined at one end to a respective leg, and including two arms that are pivotally joined, at least one of the arms being telescopic and including means for locking the arm at a predetermined length. Each step scissor unit is joined at one end to the other end of a respective split step scissor and at its other end to the other step scissor unit, and each step scissor unit includes two arms that are pivotally joined, at least one of the arms being telescopic and including means for locking the arm at a second predetermined length. The framework may further include a flexible canopy supported by the legs and quad sections, or may further include a plurality of tension cables joining ends of the legs and scissor units. Other types of quad sections are also disclosed.

11 Claims, 9 Drawing Sheets

FIG. 2C
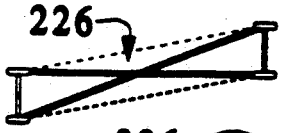
FIG. 2B
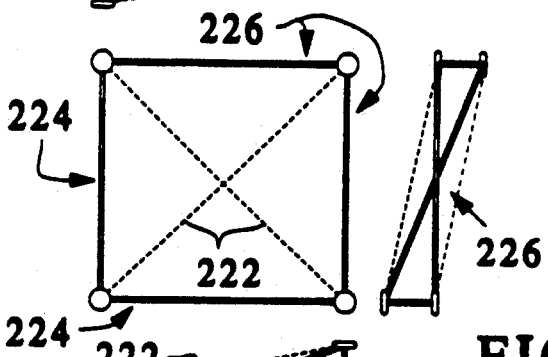
FIG. 2D
FIG. 2A
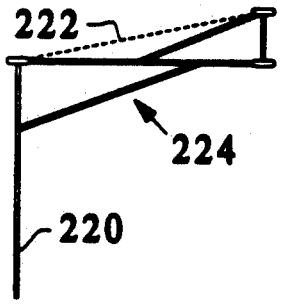
FIG. 2G
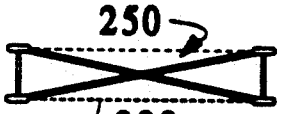
FIG. 2E
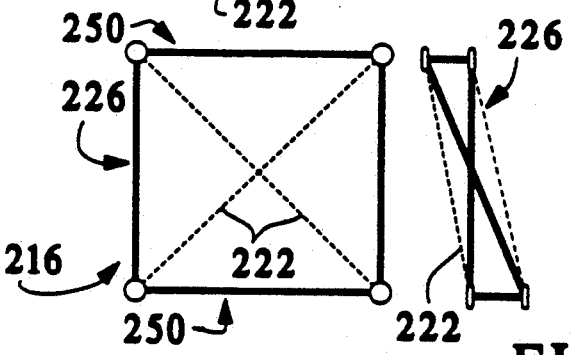
FIG. 2F
FIG. 2I
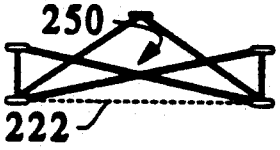
FIG. 2H
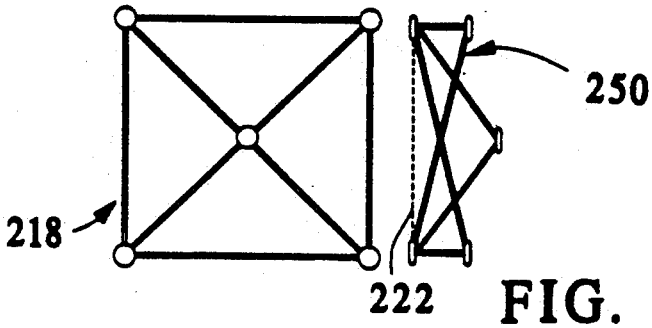
FIG. 2J FIG. 3B
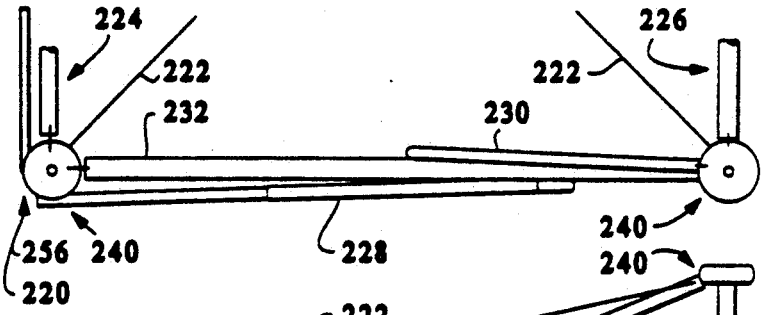
FIG. 3C
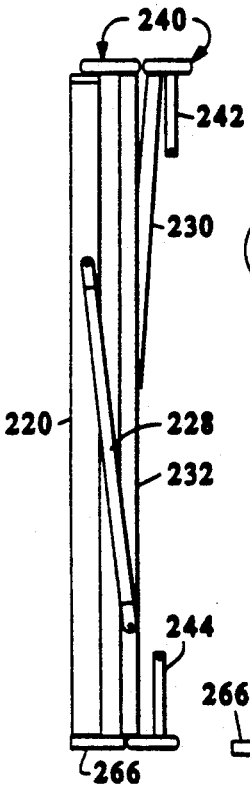
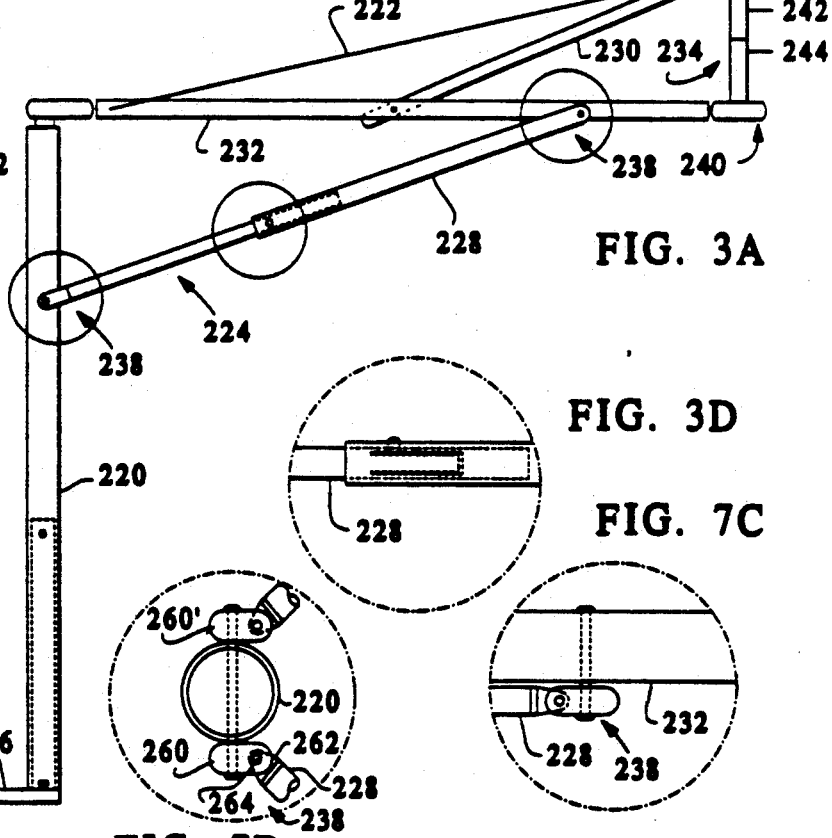
FIG. 3A
FIG. 3D
FIG. 7C
FIG. 7D FIG. 5C
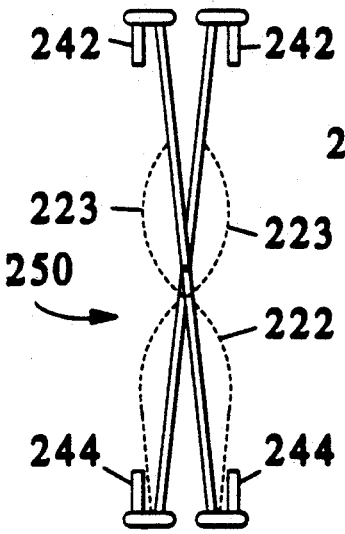
FIG. 5B
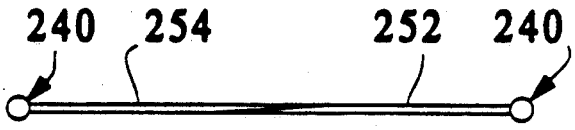
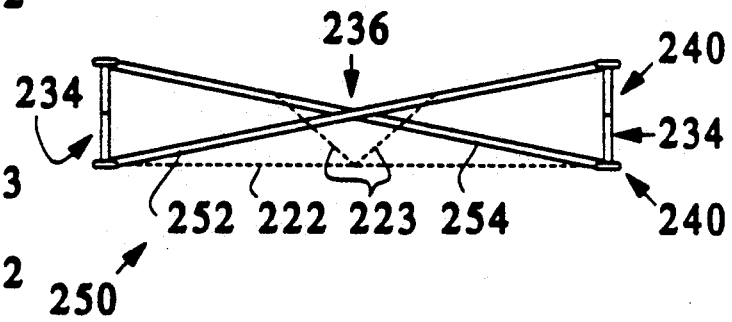
FIG. 5A
FIG. 4A
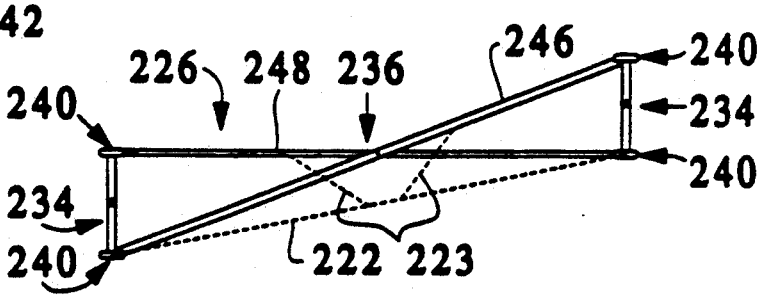
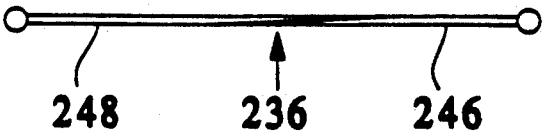
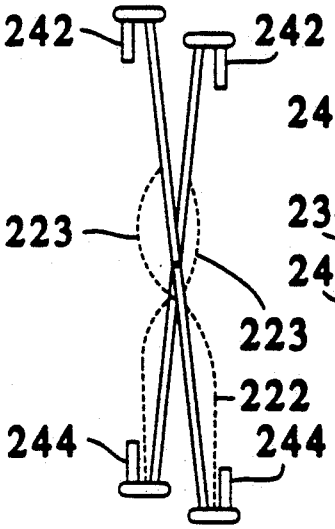
FIG. 4C
FIG. 4B

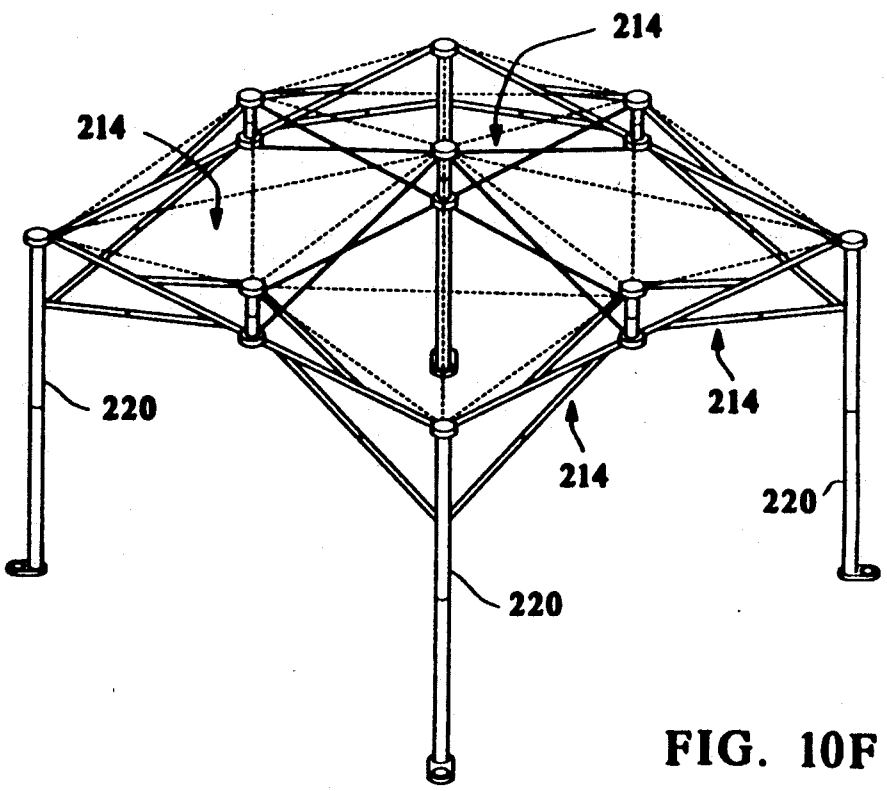
FIG. 10A
FIG. 10B
FIG. 10F
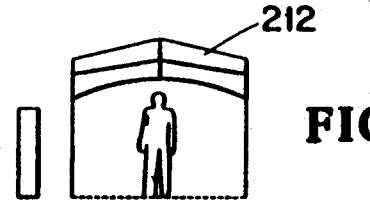
FIG. 10D
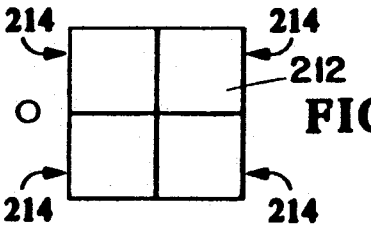
FIG. 10E
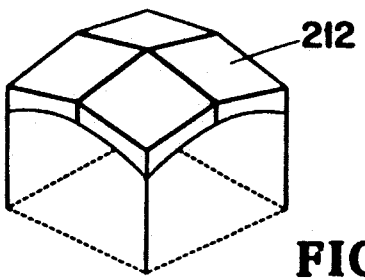
FIG. 10C

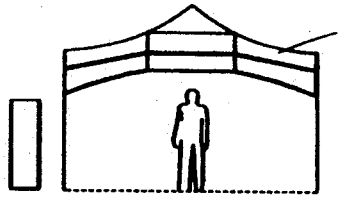
FIG. 12A
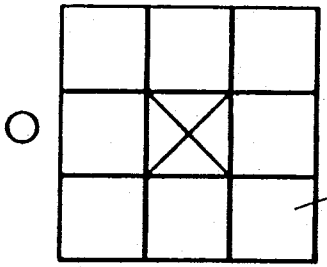
FIG. 12B
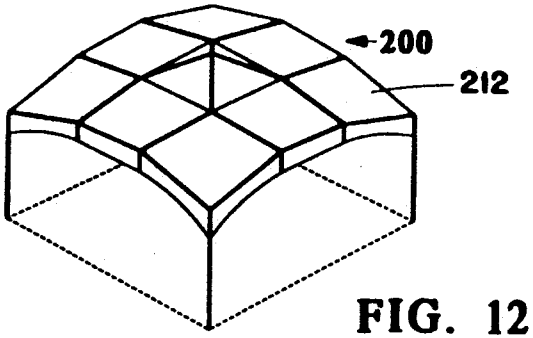
FIG. 12C
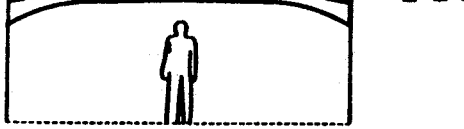
FIG. 12D
FIG. 12E
FIG. 11A
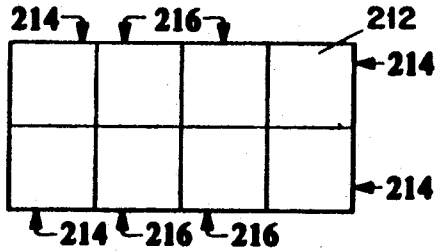
FIG. 11B
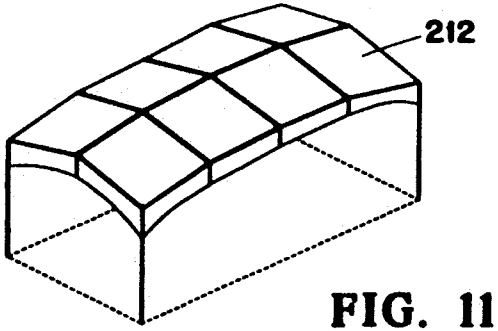
FIG. 11C
FIG. 11D
FIG. 11E

POLYHEDRON BUILDING SYSTEM HAVING TELESCOPING SCISSORS

This application is a continuation-in-part of my copending commonly assigned U.S. patent application Ser. No. 07/577,777, filed Sept. 5, 1990, for a Polyhedron Building System. This parent of the present application is expressly incorporated here by reference.

BACKGROUND

The present invention relates to collapsible canopy structures and frameworks for such structures.

Building assemblies are known that have a foldable capability so that they may be erected where desired and, when necessary, folded up to a compact form for storage and/or transportation. These assemblies employ column-like elements or rods as basic construction units that function as stays. The links are interconnected with pivot joints, slip joints, or other forms of movable interconnects so that a collapsible, articulated structure is formed. A fabric covering is usually associated with the network of rods. An example of such a collapsible structure is shown in U.S. Pat. No. 3,185,164, which shows a structure including a plurality of rods joined by couplings into groups of three which are inter-related to form a generally hexagonal structural system. Another example of such a collapsible structure is shown in U.S. Pat. No. 3,710,806. Structures that utilize elements intended to maintain the rigidity of the structure are also known, as exemplified in U.S. Pat. No. 3,063,521.

Collapsible frame structures for supporting tents or other outdoor shelters are also known. Examples of collapsible frames for use in supporting such tents or outdoor structures are shown in U.S. Pat. Nos. 563,376; 927,738; 1,773,847; and No. 2,781,766. Such structures have varied widely in their ease of erection and storage, and are of varying structural strength.

Collapsible structures are described in my prior U.S. Pat. Nos. 3,968,808; 4,026,313; 4,290,244; 4,437,275; 4,473,986; 4,512,097; 4,522,008; 4,561,618; 4,579,066; 4,689,932; 4,761,929; and No. 4,838,003. In these patents, the structural frameworks include scissor assemblies are comprised of pivotally connected members of fixed length. My U.S. Pat. No. 3,968,808 discloses a self-supporting domed shelter constructed from a series of intermeshing pentagonal or hexagonal sections, each section being composed of crossed pairs of pivotally connected struts. The generally semi-spherical framework is made of elongate struts and hub means which are movable between a collapsed, bundled condition (in which the struts are closely bundled and in a generally parallel relationship) and an expanded condition or three-dimensional form. This structural framework is self-supporting by virtue of self-locking action resulting from the asymmetrical disposition of certain struts. The framework has zones of sliding connections between crossed struts that allows the structure to be collapsed. My U.S. Pat. No. 4,026,313 discloses sliding and pivoted connections and rectangular modules, among other things, and my U.S. Pat. Nos. 4,290,244 and 4,437,275 generally are directed to structural modules.

My U.S. Pat. No. 4,689,932 discloses an octahedral module that provides the ability to build long, narrow structures or tall, wide structures. With this octahedron-based design, the struts that define the structural modules may be of equal length. The octahedron-based design also introduced a 90–45 degree coordinate system that permits "stretchability" on three axes because each of the modules has the same edge lengths. That is, the controlled addition of modules permits the basic octahedron to be dimensionally increased in three mutually orthogonal directions: height, width, and length. My patent discloses a dome structure composed of two types of square modules: a "flat" module; and a "transition", or cylindrical, module. The circumscribing sides of all the modules are formed by crossed, pivotally connected struts. With this design, the resulting building has a generally spherical shape that is substantially horizontal at the top of the structure and substantially vertical near the bottom of the structure, there being a curved portion therebetween formed by the transition modules. With this design, the corner portions of the building are left open if, for example, passageways are desired, as shown in FIGS. 1–3 of the patent. As the size of the structure increases, the open corner sections become larger.

Many typical prior building designs, including geodesic domes and conventional structures such as frame tents, suffer from several general problems. If the structure is collapsible, it is often difficult to erect and requires several workers, a significant amount of time, and special tools and equipment. The structures are also often complex in construction, having several different detachable parts and being relatively heavy and bulky in size. Non-uniformity of the sizes of the structural members also contributes to the overall complexity and cost of such structures. Many conventional structures, such as frame tents having flat roofs, are limited in their aesthetic appeal. As a result, the appropriate uses of these structures are limited.

Fabrication of some collapsible structures, such as canopies having horizontal dimensions less than about twenty feet in length, presents special concerns because access to the limited interior space should not be excessively restricted by placement of the structural members. For example, the height of the canopy, which is typically determined by the lengths of posts, or legs, disposed at its corners, usually also determines the lengths of the crossed struts, or scissor members, that form the framework supporting the roof of the structure. To obtain the desired width and height with appropriate structural stability, the scissor members may be splayed to such an extent that access to the area under the canopy is restricted.

Telescoping or otherwise changeable elements in rod frameworks are described in U.S. Pat. No. 3,940,892 to Lindbergh; No. 3,973,370 to McAllister; No. 4,641,477 to Schleck; No. 4,655,022 to Natori; and Nos. 4,888,895 and 4,942,686 to Kemeny. The Lindbergh patent describes the erection of an aircraft enclosure by forming an arch through the extension of a piston in a hydraulic cylinder. The McAllister patent discloses the erection of a structure comprising a framework having extendable struts. Schleck teaches a modular rod/truss structure having chord and diagonal members comprising turnbuckles for length adjustments that permit arch construction. Natori teaches a framework including extendable truss beams that permit fabrication of a curved structure. The Kemeny patents teach a scissors-type framework in which telescoping members permit different curvatures to be developed.

U.S. Pat. No. 4,607,656 to Carter and Nos. 4,641,676 and 4,779,635 to Lynch describe relatively small collapsible canopy structures. In each of these patents, the canopy structure comprises a flexible covering and a framework that includes a number of telescoping legs and scissor assemblies, or X-shaped linkages, between the legs. The fixed arm lengths and single pivots of the scissor assemblies significantly constrain the dimensions, i.e., the distances between the ends of the arms, achievable with such scissor assemblies because an increase in one of those distances can only be achieved by either lengthening the arms, which may make the collapsed framework unwieldy, or increasing the angle between the arms, which may restrict access to the structure.

The present invention addresses these and other problems associated with known collapsible support structures. Among its several features and advantages, the present invention provides collapsible canopy structures that have relatively small horizontal dimensions and unrestricted interior access. These features and advantages are provided by including in the framework several scissor assemblies having telescoping members, as well as the "ring and blade" hubs and locking devices described in my above-cited U.S. patents and the parent of the present application.

SUMMARY

In one aspect, the present invention provides a collapsible framework capable of being manipulated between a collapsed condition and an expanded, locked condition. The framework comprises a plurality of legs and a plurality of collapsible quad sections. The legs are disposed generally in parallel with one another and in a bundle when the framework is in the collapsed condition. Each quad section comprises two split step scissor units and two step scissor units. Each split step scissor unit is joined at one end to a respective leg, and comprises two arms that are pivotally joined, at least one of the arms being telescopic and including means for locking the arm at a predetermined length. Each step scissor unit is joined at one end to the other end of a respective split step scissor unit and at its other end to the other step scissor unit, and each step scissor unit comprises two arms that are pivotally joined, at least one of the arms being telescopic and including means for locking the arm at a second predetermined length.

In other aspects, the framework may further include a flexible canopy supported by the legs and scissor assemblies, or may further include a plurality of tension cables joining ends of the legs and scissor assemblies. In addition, the present invention encompasses frameworks comprising other types of quad section that are described further below.

An advantageous feature of a structure in accordance with the present invention is the balance between compression forces and tension forces within the structure. Suitable structural members are provided to withstand both compression and tension forces, so as to maintain the canopy structure in a structurally stable manner, while at the same time requiring fewer structural members than were required with prior structures. In this manner, the structural strength/weight ratio is increased. The structural stability and strength are increased at least in part by the use of rigid locks and periphery and diagonal cables, as explained in more detail below. The support framework, although lightweight, is structurally stable and resistant to wind forces, etc.

Other advantageous features of a structure in accordance with the present invention are the hubs and pivot joints that allow the framework's struts to pivot with respect to each other.

Yet another advantage of a canopy structure in accordance with the present invention is its ease of deployment. The structure can be erected quickly by a single person at ground level having no tools, and easily expands from a compact, pre-assembled bundle to a canopy structure having a rigid, self-supporting frame and a cover. Regardless of size, the structure can be erected in a matter of minutes. Particular design features that allow the structure to be easily erected are pivotal connections of the frame members, optional telescoping support legs, and releasable locking bar mechanisms that rigidify the framework in a quick and convenient manner. For the same reasons, the structure is also easy to collapse for transport or storage.

The structure is also advantageous in that it is relatively lightweight and, in its collapsed condition, it forms a compact bundle, which facilitates transportation and storage. For example, a portable shelter ten feet by ten feet in size collapses to a bundle that is only about five feet in length and one foot in diameter and that weighs only about thirty-five pounds. Thus, the canopy structure is easy to handle by even those persons having limited strength or mechanical capabilities.

In addition, the structure employs a waterproof cover that provides protection from the elements and may be constructed from pieces of material that are sized and configured to provide a smooth, taut cover in the expanded mode. The covering material is attached to the framework so as to not interfere with the structure's erection and collapse. Unique cover attachments securely attach the cover to the roof framework and do not interfere with an aesthetically pleasing appearance.

A structure in accordance with the present invention also employs cable members that effectively withstand the structure's tension forces and add only negligible weight. A related advantageous feature is the structure's cable keeper members, which serve to organize the tension cables of the roof structure and prevent the cables from becoming tangled during the erection or collapse of the structure. The cable keepers add little weight to the structure, yet they greatly improve the structure's ease of use, thereby making it possible to advantageously employ the structural cables.

The present canopy structure also features convenient support means which may consist of a plurality of telescoping support legs. The support means may be interconnected permanently to the roof framework, thereby greatly facilitating the collapsing and expanding operations.

Still another advantage of the present structure is its aesthetic appeal. Particularly for applications in which aesthetics are important, such as social gatherings, trade shows, exhibitions, or other applications in the special events industry, the present structure has a modernistic look.

BRIEF DESCRIPTION OF THE DRAWINGS

The features and advantages of the present invention will be understood by reading the following detailed description in conjunction with the drawings in which:

FIGS. 2A–2J show views of three types of quad section in accordance with the present invention;

FIGS. 3A-3D are views of a split step scissor unit in accordance with the present invention;

FIGS. 4A-4C are views of a step scissor unit in accordance with the present invention;

FIGS. 5A-5C are views of a flat scissor unit in accordance with the present invention;

FIGS. 7A-7D are views of a universal pivot joint;

FIGS. 10A-10F show views of one exemplary canopy structure;

FIGS. 11A-11E show views of another exemplary canopy structure;

FIGS. 12A-12E show views of the canopy structure of FIGS. 1A and 1B; and

DETAILED DESCRIPTION

Figure 1A:
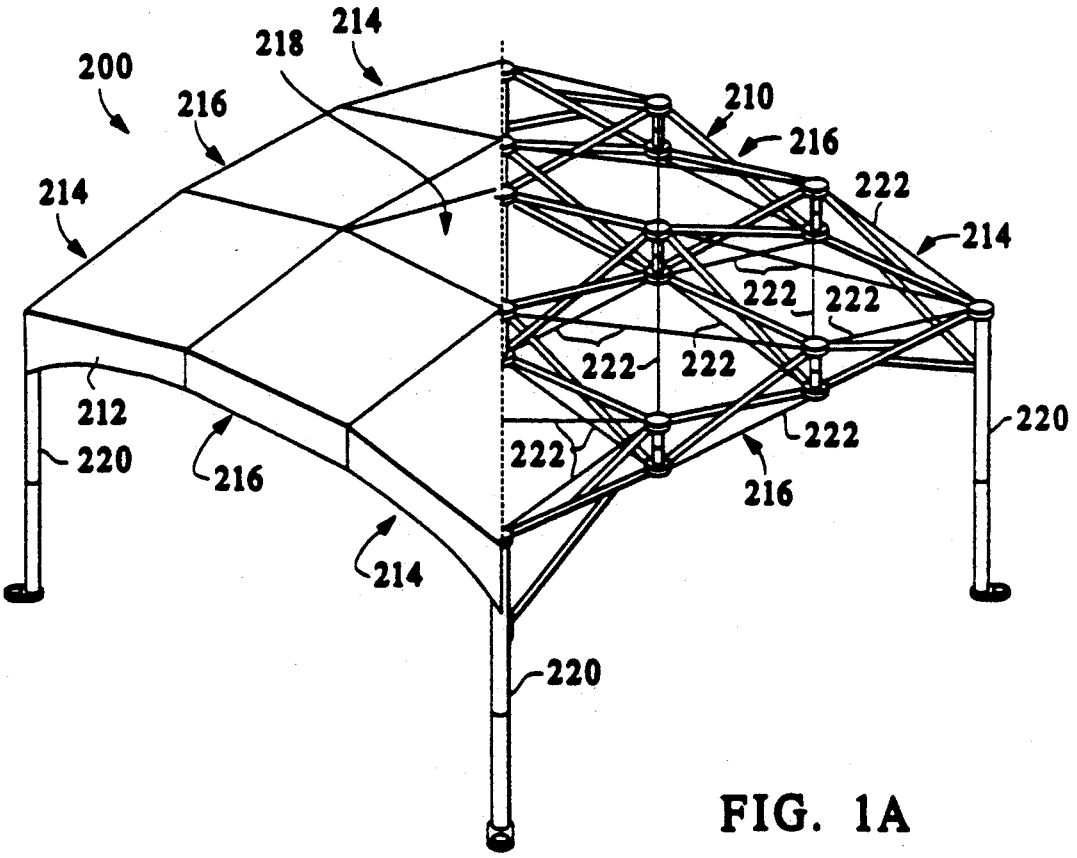
FIGS. 1A and 1B show expanded and collapsed conditions of one embodiment of a structural framework in accordance with the present invention.
Figure 1B:
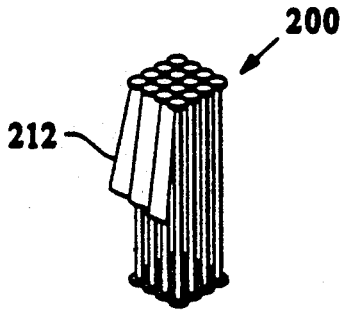

Referring now to the Figures in which like elements are identified by like reference numerals throughout, FIGS. 1A and 1B illustrate a canopy structure 200 having a support framework 210 in accordance with the present invention. The framework 210 is preferably constructed of a light-weight, rigid material, such as aluminum tubes or rods, and when expanded as in FIG. 1A the framework has a configuration that is generally square when viewed from above. The canopy structure 200, as well as other canopy configurations are described in more detail below. The framework 210 supports a flexible canopy 212, which hides the left side of the framework in FIG. IA and which is attached to the framework. As described further below, the canopy 212 may be fabricated from any suitably flexible material, such as cloth or vinyl. As illustrated in FIG. 1B, the support framework and the flexible canopy can be collapsed into a compact, easily transported condition.

The support framework 210 comprises a plurality of quad sections 214, 216, 218 that impart the general shape to the canopy structure and are described in more detail below. The four quad sections 214 at the corners of the framework 210 include upright legs 220 that optionally are telescopic. In the framework shown in FIG. 1A, three types of quad section are provided, but other frameworks may include other mixtures of quad section types as desired to achieve different canopy configurations. For example, the canopy structure illustrated in FIGS. 10A-10F employs four quad sections 214 and the canopy structure illustrated in FIGS. 11A-11E employs four quad sections 214 and four quad sections 216. Also indicated as thin lines in FIG. 1A are several flexible tension cables 222 that may be provided to stiffen the structure as described below.

The quad sections 214 are each comprised of two split step scissor units 224 and two step scissor units 226 as illustrated in the views of FIGS. 2A-2D, which also show an arrangement of diagonal and peripheral tension cables 222 as dashed lines. Similarly, the quad sections 216 are each comprised of two step scissor units 226 and two flat scissor units 250 as illustrated in the views of FIGS. 2E-2G and the quad section 218 is comprised of four flat scissor units 250 as illustrated in the views of FIGS. 2H-2J. Although it may appear from FIGS. 2A, 2E, and 2H that the quad units have square shapes, they are in fact not flat, which makes them stronger than flat sections, and are shaped more like trapezoids. It will be appreciated that quad sections (and resulting canopy structures) having other shapes, such as triangles, can also be constructed using the scissor units in accordance with the present invention. Other features and advantages of the scissor units 224, 226, 250 are described below.

Detailed side and top views of the split step scissor unit 224 are shown in FIGS. 3A, 3B, and the split step scissor unit 224 is advantageously collapsible into a compact bundle as shown in FIG. 3C. Although the two split step scissor units 224 preferably share one support leg 220, as indicated for example by FIG. 3B, it will be appreciated that a member having a different purpose could instead be provided. For example, canopy structures that would be externally supported on one side, such as canopy structures attached to or abutting other structures, would not require legs on the sides so supported. Thus, rather than four legs, only two would be provided, and four split step scissor units would not share legs.

As seen in FIGS. 3A-3C, each split step scissor unit 224 advantageously comprises arm members 228, 230, either or both of which may be telescopic, a member 232 that may or may not also be telescopic, a locking member or device 234, a number of pivot joints 236, 238, and "ring and blade" hubs 240. Only member 228 is illustrated as telescopic in FIG. 3A, which also shows one tension cable 222, and other scissor units 224, 226 are partially indicated in FIG. 3B. The locking device 234 may be that described in FIG. 8 of the parent of the present application. The hubs 240 are described in my U.S. Pat. Nos. 4,280,521; 4,761,729; and No. 4,838,003, which are expressly incorporated here by reference, and in the parent of the present application, which was incorporated by reference above. As described in more detail below, the hubs 240 provide pivotal connections between releasably interlocking sections 242, 244 of the locking member 234 and members 230, 232. In addition, the hubs 240 are shared by other scissor units. The joints 236, 238 provide pivotal connections between pairs of the members 220, 228, 230, 232. Other features of the split step scissor units are described below.

Schematic side and top views of the step scissor unit 226 are shown in FIGS. 4A, 4B, and the step scissor unit 226 is advantageously collapsible into a compact bundle as shown in FIG. 4C. As seen in FIGS. 4A-4C, each step scissor unit 226 advantageously comprises an arm member 246, which may or may not be divided into two members in the manner of members 228, 230, and an arm member 248, which may or may not be telescopic, a pair of locking members 234, at least one pivot joint 236, and "ring and blade" hubs 240. Tension cable 222 and cable keepers 223 are shown as dotted lines in the FIG. 4A. As in the step scissor unit described above, the hubs 240 provide pivotal connections between parts 242, 244 of the locking members 234 and members 246, 248; and the pivot 236 provides a pivotal connection between the members 246, 248, which may be fabricated of aluminum tubing having an outer diameter of three-quarters of an inch. Other features of the step scissor units are described below.

The quad sections 216 include two step scissor units 226 and two flat scissor units 250, and the quad section 218 includes four flat scissor units 250. Schematic side and top views of the flat scissor unit 250 are shown in FIGS. 5A, 5B, and the flat scissor unit 250 is advantageously collapsible into a compact bundle as shown in FIG. 5C. As seen in FIGS. 5A–5C, each flat scissor unit 250 advantageously comprises arm members 252, 254, which may or may not be divided into two members in the manner of members 228, 230, a pair of locking members 234, at least one pivot 236, and "ring and blade" hubs 240. Tension cable 222 and cable keepers 223 are shown as dotted lines in the FIG. 5A. As in the step scissor unit described above, the hubs 240 provide pivotal connections between parts 242, 244 of the locking members 234 and members 252, 254; and the joint 236 provides a pivotal connection between the members 252, 254. Other features of the flat scissor units are described below.

It will be appreciated that the quad section 218 is substantially similar to the flat module illustrated in FIG. 4B of the parent of the present application. In such a flat module, each side face has a rectangular shape so that the module's inner and outer faces have identical widths and lengths and define parallel planes. In addition, the flat module is of the same general shape as described in my U.S. Pat. No. 4,689,932.

Figure 6:
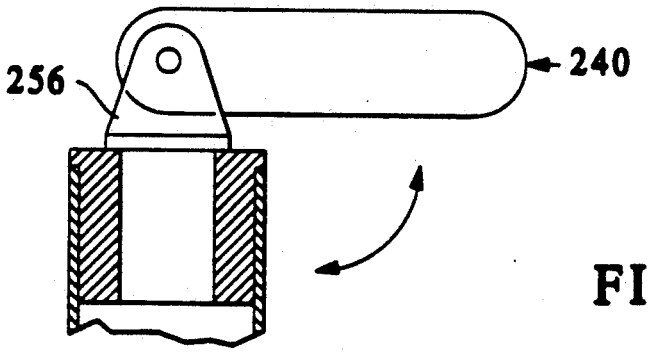
FIG. 6 is a view of a mating member for joining a ring and blade hub to a vertical member.

Top views of two of the "ring and blade" hubs 240 can be seen in FIG. 3B; the hub shown on the left in the figure is used at the top of a leg 220, and the hub shown at the right in the figure joins the split step scissor unit to another scissor unit. As seen in FIGS. 3A and 3B, the hub 240 is pivotally joined to the leg 220 by a blade 256, seen in more detail in FIG. 6 and as described in the parent of the present application. The extension portion of the blade 256 is inserted into the leg 220 and, with a suitable spacer or adapter, is fixed by, for example, threaded fasteners 258. The upper portion of the blade 256 is engaged by "ring and blade" hub 240, and thus the hub 240 can pivot freely in the direction of the double-headed arrow shown in FIG. 6. The features of the hubs 240 are as described in connection with FIG. 9A of the parent of the present application.

Figure 7A:
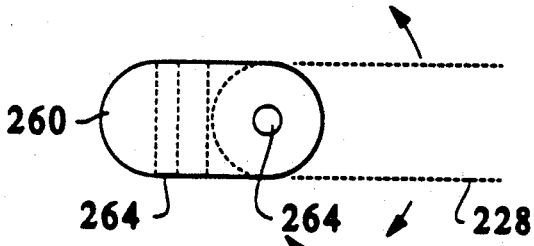
Figure 7B:
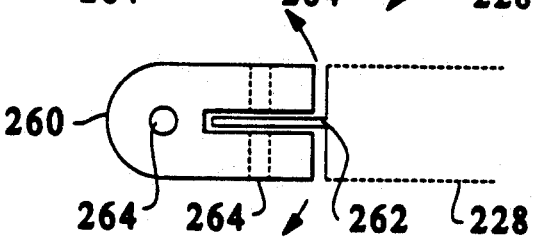

FIGS. 7A, 7B, 7C, and 7D show orthogonal and perspective views of the pivot joints 238, which advantageously act as a kind of universal joint. A mating member 260 is slotted to accept a blade 262 attached to the arm member 228; the blade is retained in the member 260 by a convenient means such as a pin 264 that permits rotation in the direction of the arrows shown in FIG. 7A. Similarly, the member 260 is attached to the leg 220 by another pin 264 that permits rotation in the direction of the arrows shown in FIG. 7B. FIG. 7C shows the pivot joint 238 that joins the arm 232 and the arm 228. As shown in FIG. 7D, one of the pins 264 may also serve to attach to the leg 220 a mating member 260' of the other split scissor unit in the quad section. The pivot joints 236 may be any means suitable for permitting the arms to pivot with respect to each other, such as a through-bolt and low-friction washers disposed among the bolt-heads and the arms.

Figure 8A:
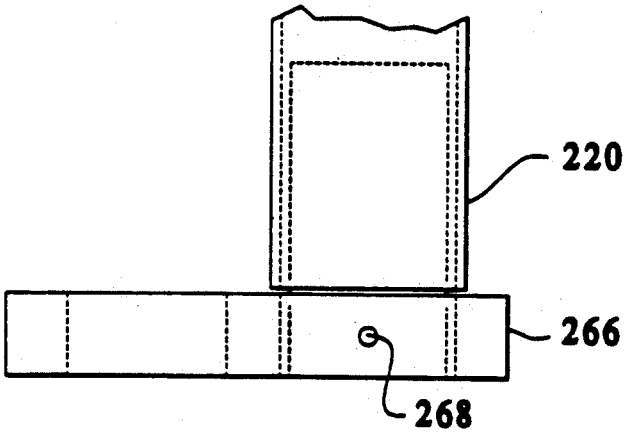
FIGS. 8A and 8B are views of a foot for the structural framework.
Figure 8B:
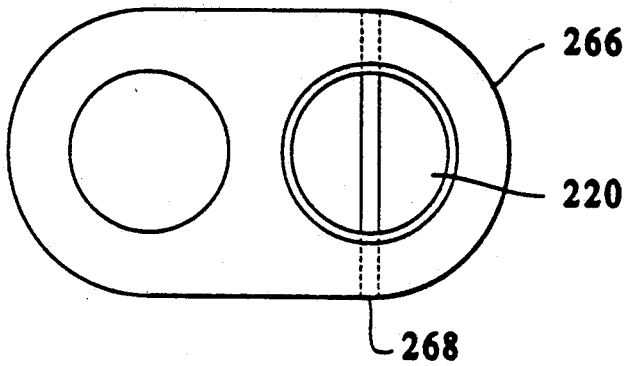

A foot member 266 may be provided as a base for a respective one of the legs 220 as illustrated in the orthogonal views of FIGS. 8A, 8B. The generally plate-like foot member 266 has two apertures therethrough, a first aperture for accepting the leg 220, and a second aperture through which a stake or other locating means may be disposed to fixedly position the canopy structure on a supporting surface. Once the leg is positioned in its aperture, a retaining pin or other locking means 268 may be inserted to hold the leg and foot together. In a structure having telescoping legs, the portion of the leg to which the foot is attached advantageously can rotate with respect to the other portion of the leg, thereby permitting the foot to move between a deployed position, as shown in FIG. 3A, and a compact stowed position, as shown in FIG. 3C.

Each leg 220 preferably consists of two concentric, telescoping tubes, and is approximately five feet long when fully collapsed. If aluminum, the tubes may have outer diameters of one-and-one-eighth and one-and-one-quarter inches. In their expanded mode, the legs 220 are approximately seven feet long. A button latch or snap lock assembly is provided on each leg 220 to maintain the legs in their expanded mode. As described in the parent of the present application, the snap lock assembly may consist of a pair of apertures in the wall of the outer tube that cooperate with a pair of detents on the inner tube. When the legs are positioned in their expanded mode, the detents snap into the apertures to maintain the legs in the expanded position. To collapse the legs, the user simply presses the detents to disengage the snap lock assemblies.

It will be appreciated that a split step scissor unit 224 resembles a conventional scissor, or X-shaped linkage, in which the crossed struts are pivotally joined at the mid-point. In contrast, either or both of the arms 228, 230 of a split step scissor unit 224 can be separated from the mid-point of the arm member 232, which may have an outer diameter of one inch when fabricated of aluminum tubing. In accordance with one feature of the invention, each of the arms 228, 230 may be pivotally joined to member 232 substantially anywhere along the length of member 232. As one example, FIGS. 3A–3C show the arm 228 joined to member 232 at a point located beyond the mid-point of member 232 and the arm 230 joined to the arm 232 at the latter's mid-point. It will also be appreciated that the arms 228, 230, rather than being disposed on opposite sides of the arm 232 as shown, may be disposed on the same side, provided appropriate steps are taken to avoid interference when collapsed.

The location of the pivot joint 238 that attaches the arm 228 to the leg 220 in the present split step scissor unit is independent of the length of the arm 232 and the height of the hub 240 at the end of the arm 236. Thus, the roof of the canopy structure can rise toward the structure's center without restricting access into the structure as would occur with a conventional scissor arrangement. In addition, it will be appreciated that lowering the location of the pivot joint 238 toward the leg's foot will generally stiffen the leg. It is only advisable to avoid the formation of forty-five-degree angles between the arm 228 and the leg 220 and arm 232 so that the two pivot joints 238 do not interfere when the split step scissor unit is collapsed.

Moreover, the split step scissor units render the quad sections 214 sufficiently rigid to avoid the need for corner three-strut leg assemblies as described in the parent of the present application. Such a three-strut leg could also adversely affect access into relatively small structures. If additional leg stiffness is needed, for example in the embodiment shown in FIG. 3A, an additional telescoping arm could be provided that would not adversely affect accessibility into the structure. Such an additional arm would be joined to the leg 220 and arm 232 by additional pivot joints 232, one additional pivot joint being located low on the leg 220 and the other additional pivot joint being located near the hub 240 joining the arm 232 to the leg.

To enable the canopy structure to be collapsed into a compact bundle and obtain the advantages provided by the present invention, one or both of the arms 228, 230 is preferably telescopic and can be locked at a predetermined length. Such lockable telescoping action is advantageously provided by fabricating the arms as concentric tubes, with the inner tube including a button latch mechanism such as described in the above-cited U.S. Pat. No. 4,641,676 to Lynch and in my co-pending, commonly assigned U.S. patent application Ser. No. 07/649,031, filed Feb. 1, 1991. The outer concentric tube need only include a hole suitable for accepting the button of the button latch mechanism. It will be appreciated that the tubes can be formed by conventional metal working processes, and for applications in which low weight is particularly desirable, the tubes could be formed of other materials, including plastics and composites. If aluminum, the tubes may have outer diameters of three-quarters and five-eighths inches.

My above-cited pending application Ser. No. 07/649,031, which is hereby expressly incorporated by reference, discloses that a suitable button latch mechanism, which is shown in cross-section in FIG. 3D, comprises a narrow strip of folded spring steel having a buttonhead formed at one end that is commercially available as part no. A-130 from Valley Tool & Die Co., N. Royalton, Ohio. It will be appreciated that the concentric tubes have severely limited rotation with respect to each other, thereby permitting reliable engagement of the button latch, and by selecting the location of the hole on the outer concentric tube, the extension of the arm can be selected. It will be further appreciated that the button latch can be disengaged and the telescoping arms and legs collapsed by simply forcing the buttonheads back through the holes. This type of button latch mechanism can be advantageously employed wherever such telescoping or snap-lock action is needed.

The possible arrangements of the tension cables 222, which generally are comprised of any suitable wire or cable, and cable retention means, which preferably consist of cable keeper members 223, are described in connection with FIGS. 5A-7C of the parent of the present application. The cable keepers serve to retain the cables 222, and can be made of a flexible or rigid material such as a thin strip of plastic or cloth material. The cable keepers could be made of a material which has elastic properties. Each cable keeper is, at one end, attached to its corresponding cable and, at the other end, attached to a corresponding arm as seen for example in FIGS. 4A and 5A. The cable keepers are preferably made of flexible plastic tape, the ends of which are adhered to the cables and arms by wrapping the adhesive sides around these components.

As the framework is collapsed, the cable keepers retain the corresponding tension cables in an organized, looped configuration, thereby preventing any problems with tangling and greatly facilitating the process of erecting and collapsing the framework. As tension members, the cables provide additional strength and structural rigidity to the framework. It will be appreciated that such rigidity can also be provided by suitably strengthened hubs and arms, but the cables have the advantage of being light and flexible, thereby facilitating collapse of the framework into a bundle. It will be understood that the alternative support cable designs described in FIGS. 5A-5C and 6A-6E of the parent of the present application can also be provided in the present framework.

Figure 9:
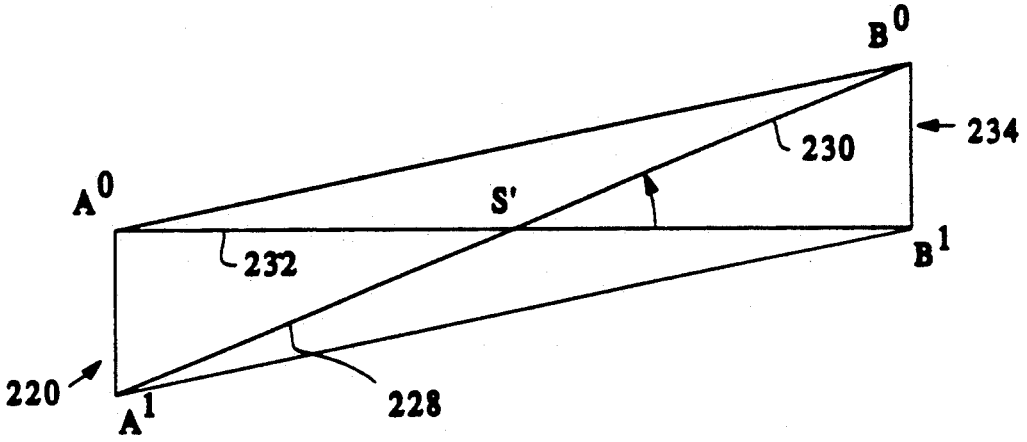
FIG. 9 illustrates the geometry of a step scissor.

FIG. 9 shows the geometry for calculating lengths of the arm members and locking members in either a split step scissor unit (illustrated in FIG. 9) or a step scissor unit. Providing that the length of the locking member 234 is equal to the length between the hub 240 at the top of the leg 220 and the leg's pivot 238, and that the locking member 234 is advantageously parallel to the leg and perpendicular to the arm 232, the included angles between the arms 230, 232 and between arms 228, 232 are 22.5 degrees. Setting the "step" height of the scissor unit (i.e., the distance between points $B^0$, $B^1$, or the length of the locking member 234) at unity, the lengths of the portions of the arm 232 between the pivot point S and the points $A^0$ and $B^1$ are both 2.41421. By geometry, the distances between points $A^1$ and $B^0$ and S are both 2.61313, and the distance between $A^0$ and $B^0$ is 4.9309.

The framework is covered with a flexible material that is held taut by the framework when expanded to its functionally operative condition. The flexible material or fabric may be attached to the framework at each outer hub by a cover connector mechanism illustrated in FIG. 10 of the parent of the present application. The flexible cover may be made of a polyester or other suitable material that may resist water, fire, and ultraviolet light. A cover button having a circular plate member and stem is insertable within a central aperture of the hub, and may be made of a plastic or other suitable material. The stem snaps easily into and out of the hub body. A fabric patch holds the button to the cover, and the patch may have a circular shape and be attached to the cover by heat-sealing or sewing. In this way, the cover can be quickly and easily removed, for example for cleaning.

The blades that are used with the struts and cables are preferably as illustrated in FIG. 11 of the parent of the present application. The outer ends of the blade members are provided with plugs received in the ends of the tubular rods, and the blades may be interconnected to the struts and cables by means of suitable fasteners or by crimping.

The shape of the erected framework is partially determined, and thus can be selected, by the number and type of quad sections used as may be seen from the above-described Figures and from FIGS. 10A-12E. FIGS. 10A-10F show a structure having horizontal dimensions ten feet by ten feet and being comprised of four quad sections 214. Such a structure, if fabricated from aluminum tubes, would weigh approximately thirty-five pounds. FIG. 10A shows the structure from the side; FIGS. 10B and 10C show the structure from the top and in perspective, respectively; FIGS. 10D and 10E show the collapsed structure from the side and top, respectively; and FIG. 10F shows the structure's framework, which as described above comprises four quad sections 216 and legs 220. Similarly, FIGS. 11A-11E show a structure having horizontal dimensions ten feet by twenty feet and being comprised of four quad sections 214 and four quad sections 216, and FIGS. 12A-12E show the structure 200 having horizontal dimensions fifteen feet by fifteen feet that was described above in connection with FIGS. 1A and 1B. These structures, if fabricated from aluminum, would advantageously weigh only seventy and eighty pounds, respectively.

In a preferred embodiment, the rods 232, 248, 254 are each approximately five feet in length, and the quad sections are interconnected to each other by sharing adjacent struts, hubs, and locking bars. The quad sections are maintained in a rigid, erected position by engagement of the locking bars 234 between the hubs 240. The center of the roof of the structure shown in FIGS. 1A and 1B is approximately twelve feet from the ground, and the legs are approximately seven feet in height, with the entire structure collapsing to a bundle approximately five feet in length and two feet in diameter.

It will be seen from FIGS. 10A–12E that the structures are conveniently comprised of repeating split-step and step scissor assemblies that have been described in the preceding Figures, and that a step scissor assembly in accordance with the present invention can achieve essentially any angle. Moreover, the length of the locking devices 234 is not limited by the length of the framework's legs, which can be deployed independently of deploying the canopy. These canopy structures are easily raised from the ground up and suffer minimal interference between the framework members and the included volume. In addition, the present structures are pre-assembled and require no additional components, which could be misplaced.

Figure 13A:
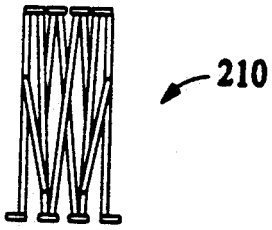
FIGS. 13A-13D illustrate the deployment steps for the canopy structure of FIGS. 1A and 1B.

FIGS. 13A–13D schematically illustrate the deployment steps for the canopy structure 200. The structure 200 is shown without the cover 212 for purposes of illustration, although the cover would preferably be attached to the roof framework. As shown in FIG. 13A, the structure 200 is a collapsed bundle of approximately five feet in length. The rods and legs are in a substantially vertical position, with the hubs being at the upper and lower ends of the bundle. The collapsed framework is maintained as a bundle by use of suitable cord or rope, and a container (not shown) may be provided for facilitating the storage and transportation of the structure.

Figure 13B:
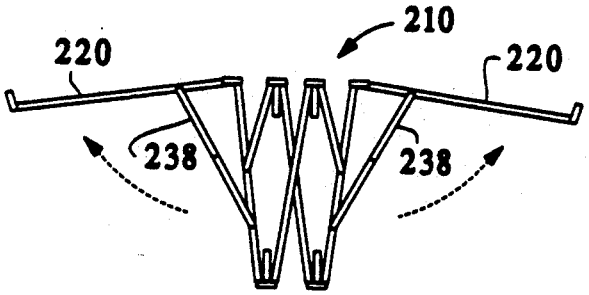
Figure 13C:
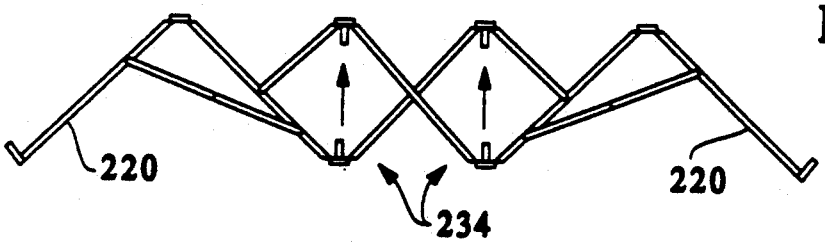

The four legs 220 are moved outward, as shown by the arrows in FIG. 13B, so that the telescoping members 238 of the split step scissor units snap into their extended positions. (Two of the legs 220 and other portions of the framework are not shown in FIGS. 13B–13D.) As shown in FIG. 13C, the framework is then expanded by pulling the structure outwardly and evenly along the ground as indicated by the arrows, thereby rotating the rods about the pivot joints 236, 238. Eventually, as is shown in FIG. 13C, the structure is pulled to its outermost position, and the quad sections 214, 216, 218 are locked into position by connecting the locking devices 234 from the underside of the structure as indicated by the arrows. Preferably, the user first engages the locking bars in the central part of the structure and then works outwardly in symmetric fashion until all of the locking bars are engaged. The locking bars maintain the quad sections in their erected positions so that the roof portion of the framework 210 is self-supporting.

Figure 13D:
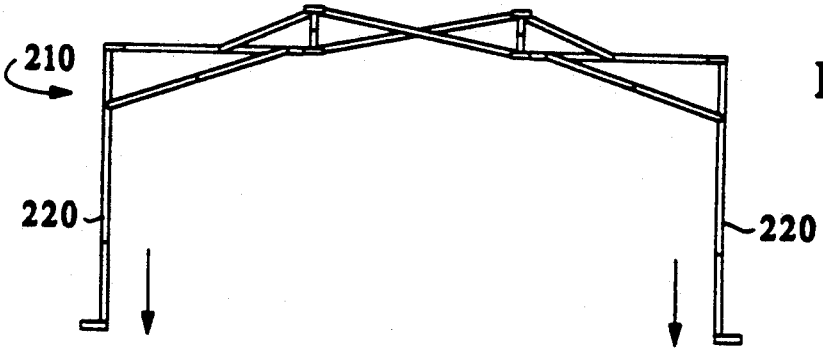

If the legs 220 are telescopic, the roof portion of the framework may then be raised above the ground by expanding the telescoping legs to their snap-locked positions as indicated by the arrows shown in FIG. 13D. It is possible to raise the legs either separately or simultaneously. When all of the legs have been raised, the framework 210 (and the structure 200) assumes the erected position illustrated. As a final step, the support feet 266 may be secured to the ground by stakes. It will be appreciated that the separate deployment of the roof portion and legs of the structure, as well as the separate deployment of each of the quad sections, significantly simplifies the erection and collapse of the canopy structure.

The foregoing description is intended in all senses to be illustrative rather than restrictive. Other embodiments of the invention will suggest themselves to those of ordinary skill in the art, and those embodiments that fall within the spirit and scope of the following claims are intended to be included therein.

What is claimed is:

1. A structural framework capable of being manipulated between a collapsed condition and an expanded, locked condition comprising:

a plurality of legs disposed generally in parallel with one another and in a bundle when the framework is in the collapsed condition; and a plurality of collapsible quad sections, each quad section comprising two split step scissor units, each split step scissor unit being pivotally fixed at one end to one of the plurality of legs and comprising two arms that are pivotally joined, at least one of the arms of the split step scissor unit being collapsible and including means for locking the collapsible arm of the split step scissor unit at a predetermined length and two step scissor units, each step scissor unit being joined at one end to a second end of a respective split step scissor unit, second ends of each step scissor unit being joined to each other, wherein each step scissor unit being collapsible and including means for locking the collapsible arm of the step scissor unit at a second predetermined length.

2. The framework of claim 1, further including a flexible canopy supported by the legs and quad sections.

3. The framework of claim 1, further including a tension cable joining an end of one of the plurality of legs and at least one of the split step scissor units.

4. The framework of claim 1, wherein each leg is telescopic and includes means for locking the leg at a third predetermined length.

5. The framework of claim 1, further comprising a plurality of second collapsible quad sections interposed between adjacent collapsible quad sections, each second quad section comprising two step scissor units, each step scissor unit being one of the step scissor units in adjacent collapsible quad sections and two flat scissor units, each flat scissor unit being joined at open end to a first one of the two step scissor units of the second quad section and, at a second end, to a second one of the two step scissor units of the second quad section, wherein each flat scissor unit comprises two arms that are pivotally joined, at least one of the arms of the flat scissor unit being collapsible and including means for locking the collapsible arm of the flat scissor unit at a third predetermined length.

6. The framework of claim 5, further comprising a third collapsible quad section interposed between four adjacent collapsible quad sections, the third quad section being formed by four flat scissor units, each of the four flat scissor units forming a part of a corresponding second quad section, the four flat scissor units being joined at their ends, each flat scissor unit also being joined at each end to two respective step scissor units.

7. The framework of claim 1, further including a tension cable joining an end of one of the plurality of legs and at least one of the step scissor units.

8. The framework of claim 1, wherein the collapsible arm of the split step scissor unit is telescopic.

9. The framework of claim 1, wherein the collapsible arm of the step scissor unit is telescopic.

10. The framework of claim 1, wherein the collapsible arm of the flat scissor unit is telescopic.

11. The framework of claim 6, further comprising a collapsible quad section including four flat scissor units joined, one to the other, at their ends, at least one end of the flat scissor units being joined to one of a flat scissor unit and a step scissor unit.

* * * * *

UNITED STATES PATENT AND TRADEMARK OFFICE

CERTIFICATE OF CORRECTION

PATENT NO. : 5,274,980
DATED : January 4, 1994
INVENTOR(S) : Zeigler

It is certified that error appears in the above-indentified patent and that said Letters Patent is hereby corrected as shown below:

In claim 1, at column 12, line 27, after "unit" insert --comprises two arms that are pivotally joined, at least one of the arms of the step scissor unit--.

In claim 5, at column 12, line 46, "open" should be "one".

In claim 6, at column 12, line 57, after "adjacent" insert --second--.

In claim 10, at column 13, line 3, "claim 1" should read "claim 5".

Signed and Sealed this

Twenty-third Day of August, 1994

Bruce Lehman

*Attest:*

BRUCE LEHMAN

*Attesting Officer*

*Commissioner of Patents and Trademarks*